United States Patent [19]

Gander

[11] Patent Number: 4,726,687

[45] Date of Patent: Feb. 23, 1988

[54] ANALOG TIMEPIECE WITH DEVICE FOR ELECTRONIC DATA INPUT

[76] Inventor: Franz Gander, Huobboden 5, CH-6370 Stans-Oberdorf, Switzerland

[21] Appl. No.: 918,119

[22] Filed: Oct. 14, 1986

[30] Foreign Application Priority Data

Oct. 16, 1985 [CH] Switzerland ..... 04428/85

[51] Int. Cl.[4] ..... H01B 47/00

[52] U.S. Cl. ..... 368/10; 368/44; 368/70; 368/80; 368/321

[58] Field of Search ..... 368/10, 41, 44, 70, 368/74, 80, 73, 319–321

[56] References Cited

U.S. PATENT DOCUMENTS

| | | | |
|---|---|---|---|
| 4,044,242 | 8/1977 | Laesser | 368/10 |
| 4,196,583 | 4/1980 | Kumaki | 368/73 |
| 4,268,913 | 5/1981 | Nakagiri et al. | 368/320 |
| 4,374,622 | 12/1983 | Kashio | 368/74 |
| 4,449,832 | 5/1984 | Kammerer | 368/321 |
| 4,459,031 | 7/1984 | Perucchi | 368/74 |

FOREIGN PATENT DOCUMENTS

| | | | |
|---|---|---|---|
| 1391637 | 4/1975 | United Kingdom | 368/10 |

*Primary Examiner*—Bernard Roskoski
*Attorney, Agent, or Firm*—Marshall & Melhorn

[57] ABSTRACT

A timepiece includes a conventional circular analog display surrounded by one or more data entry dials. Data selection means such as a pointer or a window are utilized to select one of a plurality of uncoded characters on the data entry dial thereby enabling an associated coded character formed on the periphery of a rotatable wheel to be read. A stem is coupled to drive the wheel and also functions to enable the reading head to generate a data entry input signal. The signal from the reading head is an input to one or more memories associated with an alphanumeric display for visually indicating the entered information, and/or stored information and/or calculated information.

7 Claims, 3 Drawing Figures

ANALOG TIMEPIECE WITH DEVICE FOR ELECTRONIC DATA INPUT

BACKGROUND OF THE INVENTION

The invention relates in general to an analog timepiece and, in particular, to a watch with a device for electronic data input.

Timepieces measure and show the progress of time as well as store and display data and information. While the older mechanical clocks and watches only provided information concerning the course of the terrestrial time, the necessary data input and display devices for these functions were modest. It was sufficient to have a mechanical timing mechanism and dial with which the hands and the calendar could be adjusted.

With the new electronic developments, timepieces have approached the domain of humanity and are beginning, to a greater extent, to record personal data of the user and supply information about him. Thus, it is necessary to enlarge the scope of the device for the data input. It is desirable to be able to enter letters, numbers and instructions. Many solutions to the problem of increased input capacity for watches are known, which are all confronted with the problem of the relatively small equipment and the relatively large fingers of the user. Such watches have mostly a plurality of push buttons for the choice of a mode and for the input of an instruction. For entering letters and numbers, keyboards similar to a computer are used, from which the desired characters are transmitted to the memory of the watch. There even exists a watch by which a number to be entered can be written on the glass or crystal covering the display. A desired character can even be controlled by digital means on a mini-keyboard arranged on the digital display of the watch.

It is an object of the invention to provide a device, which makes it possible to enter easily and intelligibly a plurality of letters, numbers and instructions through a single, easily grasped stem of the watch.

BRIEF DESCRIPTION OF THE DRAWING

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
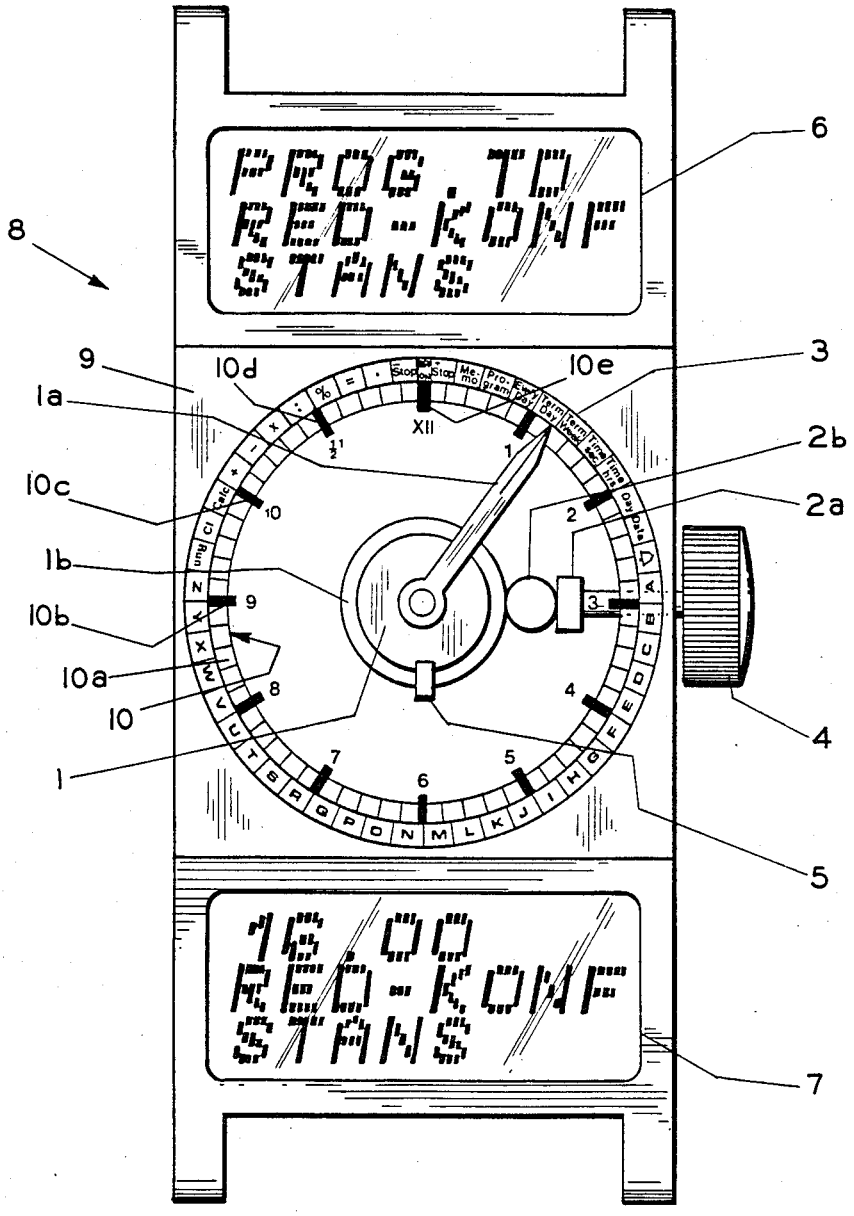
FIG. 1 is a plan view of a watch with a portion of the dial removed and incorporating the present invention.

A timepiece according to the present invention is shown herein as an analog watch, but the present invention could also be utilized in any other form of a timepiece such as a clock. A watch 8, shown in FIG. 1, includes a case 9 which houses a conventional timekeeping apparatus or mechanism (not shown). On an outer surface of the case 9 there is formed a generally circular time indicating dial 10 having a plurality of minute increment markings 10*a* and hour increment markings 10*b*. The timekeeping apparatus can drive at least a pair of time indicating hands, such as an hour hand and a minute hand (not shown in order not to obscure portions of the present invention). A conventional second hand might also be included. Such hands are driven by the timekeeping apparatus to point towards selected ones of the increments 10*a* and 10*b* thereby indicating the time according to the timekeeping apparatus. In the alternative, the increments 10*a* and 10*b* could be provided with light emitting means such as light emitting diodes which are activated in response to the timekeeping apparatus in order to visually indicate the time. In any event, the timekeeping apparatus and time indicating means are conventional and well known in the art.

There is positioned at the center of the time indicating dial 10, a wheel 1 which is not driven by the timekeeping apparatus. A pointer 1*a* can have one end attached at the center of the wheel 1 and an opposite end positioned adjacent the time indicating dial 10. The pointer 1*a* is attached to the wheel 1 and the wheel 1 is mounted for rotation on the case 9.

The wheel 1 has a band 1*b* formed about its periphery. The band 1*b* represents a plurality of spaced characters in coded form. Any of several methods of coding can be utilized such as perforation, magnetization, or electrical contact means. A data entry dial 3 in the form of a ring is positioned concentric with and about the outer edge of the time indicating dial 10. The data entry dial 3 is divided into a plurality of segments each of which may have an uncoded character formed thereon. The uncoded characters on the data entry dial 3 each correspond to a coded character on the band 1*b*. When the pointed end of the pointer 1*a* is adjacent one of the segments on the data entry dial 3, the corresponding coded character on the band 1*b* is adjacent a reading head 5 attached to the case 9. The reading head 5 is conventional in form and corresponds to the type of coding utilized on the coded characters on the band 1*b*. The reading head 5 senses the coded character and generates an output signal when an enlarged head of a watch stem 4 is moved with respect to the case 9 as will be discussed below.

Although sixty characters are shown on the data entry dial 3, there can be more or less characters depending upon the functions to be performed by the watch. In FIG. 1, there are characters representing a mode of operation, letters of the alphabet, and arithmetic operation signs. The indicators for entering numerical information are the hour indicators of the time indicating dial 10. For example, the ten hour indicator 10*c* can signify zero numerical input (a small one and a large zero) when the pointer 1*a* is adjacent thereto. The hour eleven can signify the value one half (a small one half and a small one) for use in entering half hour steps for any of the many time zones with half hour values. The twelve hour indicator is a Roman numeral XII which can be utilized to indicate, for example, "on/off" for the beginning and ending of a data entry.

When the data entry dial 3 is of a relatively large diameter, a large number of characters do not present a readability problem. It is more difficult to read characters when the diameter of the data entry dial becomes smaller and, in that instance, several solutions are possible. The data entry dial 3 could be formed as a ring rotatably mounted on the case 9 and coupled for corotation with the wheel 1. The pointer 1*a* could be replaced by a window formed in the case 9 over the data entry dial 3 through which the underlying characters become visible. The readability can be improved by fitting the window with a small lens for magnifying the characters. Such a window and lens are well known in the watch art.

In the alternative, two or more pointers 1*a* can be utilized, each with a different length and associated with a different diameter of the corresponding number of concentric ones of the data entry dials. Thus, each dial could be formed with a smaller number of larger characters. Other combinations of these two forms can be utilized such as multiple windows with multiple dials or a combination of a pointer and a window each with a separate dial. One of the dials could be utilized to display characters representing modes of operation, whereas the other one of the dials could be utilized to display characters representing letters and arithmetic operation signs.

In another embodiment, the data entry dial 3 can be formed as two or more concentric rings each having characters formed thereon for cooperation with the single pointer 1*a*. The pointer 1*a* is first associated with one of the characters on a first one of the rings representing modes of operation, and, after the mode of operation has been entered, the characters from one or more other rings can be read utilizing the pointer 1*a*.

The stem 4 has an enlarged head located outside the case 9, as shown, and includes a shaft portion which extends through the case 9 and is coupled to a first gear 2*a*. The first gear 2*a* engages a second gear 2*b* which is coupled to the wheel 1. Thus, rotation of the stem 4 about its longitudinal axis utilizing the enlarged head results in rotation of the wheel 1 and pointer 1*a* about their axes of rotation. Any conventional gear means can be utilized including toothed gears and frictionally engaged wheels.

The gears 2*a* and 2*b* are also representative of an alternative means for driving the wheel 1 such as an electric stepping motor. The stem 4 then becomes a control or actuator for an electric switch which in turn controls power to the stepping motor in a conventional manner. Since the position of the drive shaft of a stepping motor is representative of the position of the pointer 1*a* relative to the data entry dial 3, the means for entering data from the signal generated by the reading head 5 can be controlled in such a manner as to only read in a first instance when the pointer 1*a* is adjacent a mode of operation character on the data entry dial 3. After the mode of operation signal has been entered by pressing the stem 4, any one of the other characters which do not represent a mode of operation can be read in a similar manner. For example, if a calculating mode of operation or a time in hours mode operation is selected, only the numbers on the time indicating dial 10 and the arithmetic operation signs on the data entry dial 3 will be able to be entered by pushing the stem 4. Other modes of operation can be selected to allow the entry of the letters of the alphabet.

Figure 2:
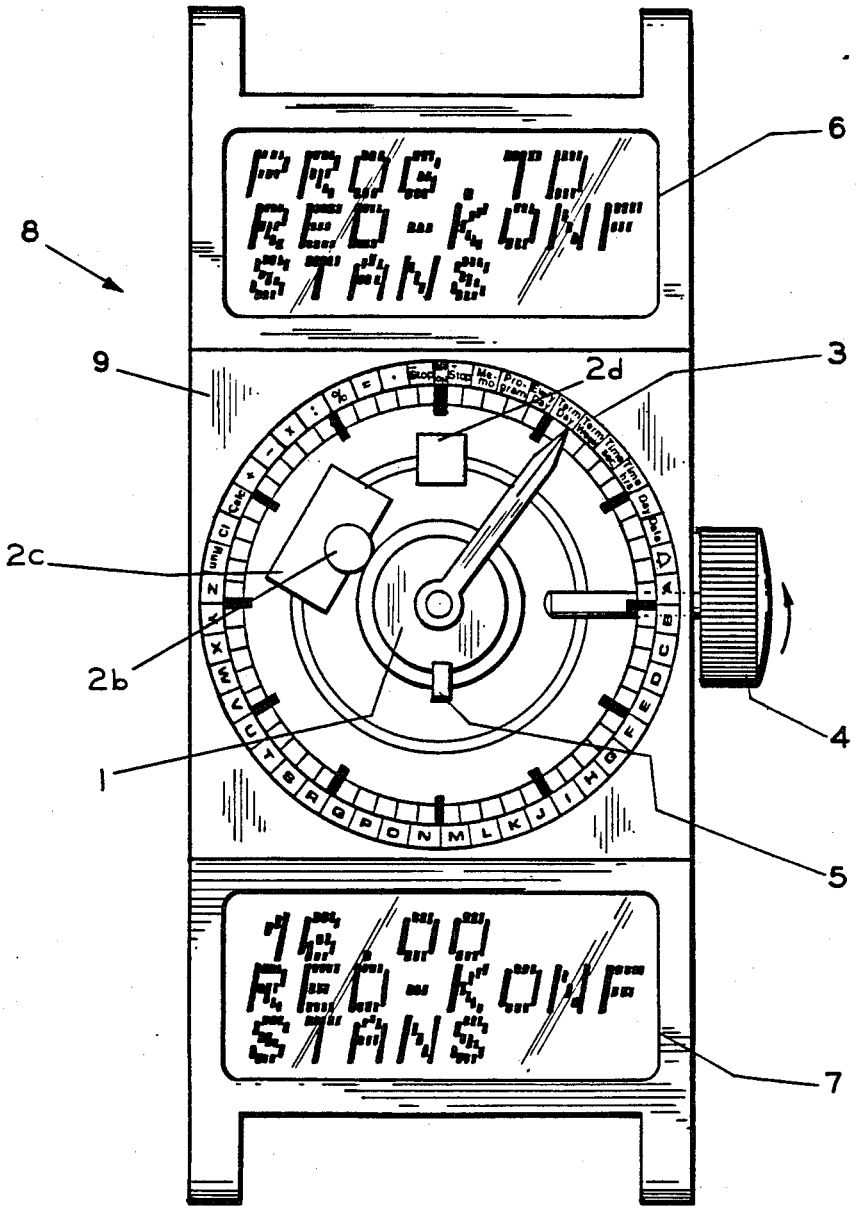
FIG. 2 is a plan view of a watch with a portion of the dial removed showing an alternate embodiment of the present invention.

There is shown in FIG. 2 an alternate embodiment of the present invention for driving the wheel 1. An electric stepping motor 2*c* drives the gear 2*b* which in turn is coupled to the wheel 1. The motor 2*c* is independent of the timekeeping mechanism and is connected to a conventional logic circuit 2*d* which controls and commands the stepping motor 2*c*. The logic circuit 2*d* is connected to and is responsive to the position and movement of the stem 4 for controlling the stepping motor 2*c* to move the pointer 1*a* through the wheel 1.

Figure 3:
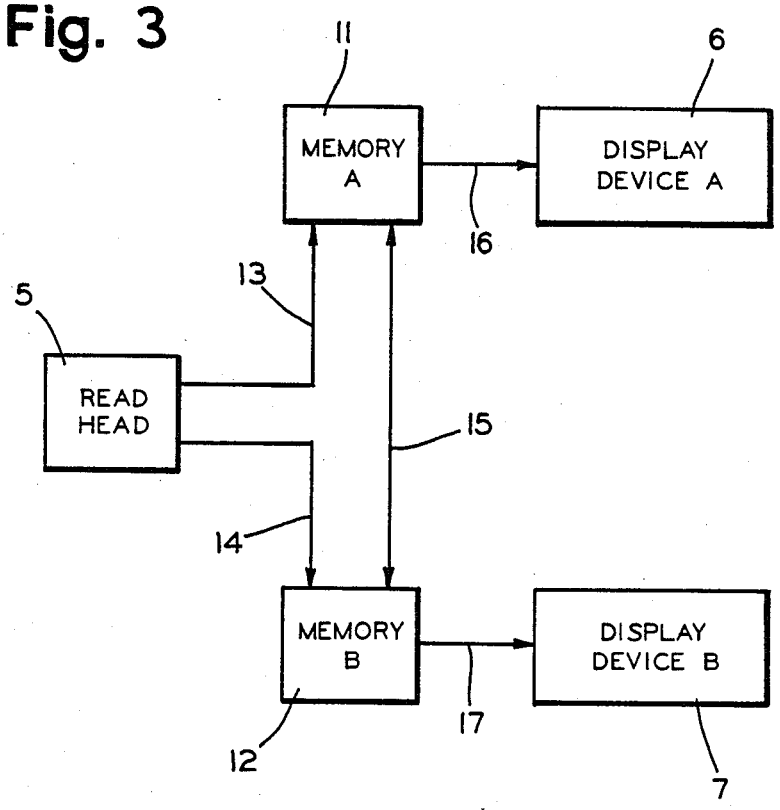
FIG. 3 is a block diagram of the reading head, memories and display devices according to the present invention.

FIG. 3 is a block diagram of the reading head 5, the digital displays 6 and 7, and a pair of associated memories 11 and 12. The reading head 5 is responsive to the binarily coded characters on the band 1*b* of the wheel 1 for generating data entry signals to the memory 11 on a line 13 or to the memory 12 on a line 14. The memories 11 and 12 are connected by a bidirectional line 15 for transferring stored information between the memories. The memory 11 is connected to the display 6 by a line 16 and the memory 12 is connected to the display 7 by a line 17 for displaying information stored in the memories in response to data entry signals from the reading head 5.

Although the stepping motor serves to rotate the wheel 1 and pointer 1*a*, can also be temporarily coupled with a setting wheel (not shown) for the clock hands in a conventional manner.

The stem 4 can be rotated in either direction about its longitudinal axis for selecting the location of one or more pointers 1*a*, rotating the clock hands, or even generating signals to control digital displays as will be discussed below. The stem 4 can be pressed toward the case 9 to enable a selected character to be inputed through the reading head 5. Finally, the stem 4 can be pulled, e.g. for interrupting and terminating a mode of operation. The pushed and pulled stem 4 returns automatically to its original position. If a stepping motor is provided, the stem 4 could be in the form of a joystick located at any convenient position on the watch thereby enabling the case 9 to be hermetically sealed in order to protect highly sensitive mechanisms and/or electronics.

The watch 8 includes a pair of digital displays 6 and 7 located in the case 9 on either side of the time indicating dial 10. The displays 6 and 7 are conventional in form and include a memory. Typically, the displays 6 and 7 are alphanumeric and, in the simplest form, are associated with a read only memory containing instructions for driving the display elements. If one or both of the displays 6 and 7 were of this form, signals from the reading head 5 would select the desired instruction in the memory thereby enabling the associated display screen to present the visual indication of the stored information. One or both of these memories could also include a random access memory for storing information entered through the reading head and/or the memory associated with the other one of the displays. Further, one or both of the memories could include instructions for performing arithmetic calculations and time and date calculations. For example, since the time indicating dial 10 displays the hours, minutes and possibly seconds, the displays 6 and 7 can display such information as the date, AM and PM, and any special designation for the date, for example, Easter. Other information which can be displayed includes elapsed time from a selected starting time and count down time remaining to a selected time to the future. Additional information can include dates to remember, telephone numbers, and things to do. Also, the displays function to visually indicate numerical data during calculations and the final results.

The memories associated with the displays 6 and 7 can also be linked together for entering data which can be transferred at a future given time. For example, if you know that a task must be repeated every two weeks, it is possible to store this concept in the memory associated with the display 6. Then, when you later determine the starting date for the series, the pointer is positioned to select the "Program" mode of operation.

Subsequent rotation of the pointer 1*a* will cause each of the stored concepts to be displayed in sequence. When the associated concept is displayed, the pointer 1*a* is stopped. The pointer 1*a* is then rotated in the opposite direction to cause a series of dates spaced apart by two weeks to be displayed by the display 7. When the desired starting date is reached, the pointer 1*a* is stopped and the stem 4 is pressed to enter the selected task into the memory at each of the selected dates.

Additional information can be stored in the memory such as the time differences to other time zones. If it is necessary to change the watch to conform with one of the stored time zones, the operational modes "Program" and "Time hrs" are selected. Rotation of the stem 4 will cause the name of the city and associated indication of the time difference to appear. When the selected city is displayed, the stem 4 is depressed and the watch hands are automatically reset to the proper time zone. It is also possible to automatically cause the time change by storing in the memory associated with the display 7 a desired date and time of changeover which will cause the changeover to automatically occur.

The watch according to the present invention maintains the traditional analog display of time while providing a much enhanced input device for data. The conventional time display also serves as an indicator for numerical data inputs thereby freeing the alphanumeric displays for the presentation of additional information.

In accordance with the provisions of the patent statues, the present invention has been described in what is considered to represent its preferred embodiment. However, it should be noted that the invention can be practiced otherwise than as specifically illustrated and described without departing from its spirit or scope.

What is claimed is:

1. In a timepiece including a case adapted to house a timekeeping apparatus for driving a time display, a data input device comprising:

a generally circular data entry dial having a plurality of logically different uncoded characters formed thereon;

a data entry indicating means for indicating a selected one of said uncoded characters, at least one of said data entry dial and said data entry indicating means being movable with respect to the other one for selectively indicating any one of said uncoded characters;

a wheel mounted for rotation about its axis and having a band of a plurality of different binarily coded characters formed about its periphery, each of said coded characters corresponding to at least one of said uncoded characters;

a reading head positioned adjacent said band on said wheel and responsive to each of said binarily coded characters for generating a corresponding data entry signal; and means for rotating said wheel and for moving one of said data entry dial and said data entry indicating means with respect to the other to select one of said uncoded characters whereby said reading head generates said associated data entry signal when said one of said uncoded characters is selected.

2. An analog timepiece including a case housing a timekeeping mechanism adapted to be coupled to at least a pair of time indicating hands, and a time indicia dial for cooperating with at least a pair of time indicating hands for visually displaying time information, and a data input device mounted on the case comprising:

a wheel mounted for rotation on the case;

a band of a plurality of different binarily coded characters formed on a periphery of said wheel;

a pointer having one end attached to said wheel;

a generally circular data entry dial coaxial with said wheel and defining a generally circular path of travel of an opposite end of said pointer, said data entry dial having a plurality of logically different uncoded characters formed thereon corresponding to said binarily coded characters;

a reading head positioned adjacent said peripheral band on said wheel and responsive to said binarily coded characters for generating a data entry signal; and means for rotating said pointer and said wheel whereby when said pointer is adjacent one of said plurality of logically different uncoded characters, said head is responsive to an associated one of said plurality of binarily coded characters for generating an associated data entry signal.

3. The device according to claim 2 wherein said means for rotating said pointer and said wheel includes a stem extending through and rotatably mounted in a wall of the timepiece case and gear means located inside the case and coupled between said stem and said wheel whereby rotation of said stem about a longitudinal axis causes rotation of said wheel and said pointer.

4. The device according to claim 2 wherein said means for rotating said pointer and said wheel includes an electric motor independent of the timekeeping mechanism and coupled to drive said pointer and said wheel in rotation, and a stem extending through a wall of a timepiece case and coupled to said motor whereby movement of said stem relative to the case actuates said motor to rotate said wheel and said pointer.

5. The device according to claim 2 wherein said means for rotating said pointer and said wheel includes a stem extending through a wall of a timepiece case and coupled to said reading head whereby movement of said stem relative to the case enables said reading head to generate said data entry signal.

6. The device according to claim 2 including a pair of alphanumeric display devices each connected to one of a pair of memories for storing information wherein at least one of said memories is responsive to said data entry signal for displaying said stored information on the associated one of said display devices.

7. The device according to claim 6 wherein said memories are connected together for transferring said stored information between said memories.

* * * * *